United States Patent [19]

Luijks et al.

[11] Patent Number: 5,053,676

[45] Date of Patent: Oct. 1, 1991

[54] HIGH-PRESSURE DISCHARGE LAMP

[75] Inventors: Gerardus M. J. F. Luijks; Hendrik M. Bleeker, both of Eindhoven, Netherlands

[73] Assignee: U.S. Philips Corporation, New York, N.Y.

[21] Appl. No.: 597,619

[22] Filed: Oct. 11, 1990

[30] Foreign Application Priority Data

Dec. 6, 1989 [NL] Netherlands ..... 8902999

[51] Int. Cl.[5] ..... H01J 19/78

[52] U.S. Cl. ..... 315/58; 315/46; 315/53; 315/59; 315/73

[58] Field of Search ..... 315/46, 53, 58, 59, 315/73

[56] References Cited

U.S. PATENT DOCUMENTS 4,134,042 1/1979 Van Heems Korck Veeckens ..... 315/53

4,520,294 5/1985 Iida et al. .

*Primary Examiner*—Eugene R. LaRoche

*Assistant Examiner*—R. Ratliff

*Attorney, Agent, or Firm*—Brian J. Wieghaus

[57] ABSTRACT

The invention relates to a high-pressure discharge lamp provided with a discharge vessel enclosed with intervening space by an outer bulb. An ignition circuit within the outer bulb includes a voltage-dependent capacitor. According to the invention, the capacitor is mounted in a gas-filled glass capsule in the outer bulb.

4 Claims, 1 Drawing Sheet

HIGH-PRESSURE DISCHARGE LAMP

Cross Reference To Related Applications

The copending application Ser. No. 597620 filed concurrently herewith entitled "High Pressure Discharge Lamp" of Luijks et al discloses and claims a discharge lamp having a starting circuit having a voltage-dependent resistor and a voltage-dependent capacitor in a gas-filled capsule which is mounted either in the lamp envelope or the lamp cap.

The copending application Ser. No. 597624 filed concurrently herewith entitled "High Pressure Discharge Lamp" of Luijks et al discloses and claims a discharge lamp having a starting circuit which includes a capacitor mounted in a gas-filled, gas-tight capsule in the lamp cap.

BACKGROUND OF THE INVENTION

The invention relates to a high-pressure discharge lamp provided with a discharge vessel, which vessel is enclosed with intervening space by an outer bulb having a lamp cap, as well as with an ignition circuit comprising a voltage-dependent capacitor.

A lamp of the type described in the opening paragraph is known from German Patent DE-C-3330266. In the known lamp, which is suitable for operation in series with a stabilizing ballast from an AC voltage supply source, the capacitor is positioned in the outer bulb and provided with a glass envelope to protect it against reduction and evaporation of parts of the capacitor. Practice has shown, however, that this entails major disadvantages. On the one hand, manufacture of a capacitor provided with such an envelope is very difficult, which makes the capacitor very expensive. On the other hand, the known lamp turns out to have a high degree of early failures owing to capacitor breakdown.

Positioning of the capacitor in the outer bulb, however, is attractive on account of a relatively simple lamp manufacturing method, caused by, among other factors, the availability of comparatively much space, in contrast to, for example, in the lamp cap. The invention has for its object to provide a means by which the disadvantages described are obviated while a comparatively simple lamp manufacturing method is maintained.

SUMMARY OF THE INVENTION

According to the invention, this object is achieved in a lamp of the type described in the opening paragraph in that the capacitor is mounted in a gas-filled gas-tight glass capsule in the outer bulb.

The advantage of this is that the capacitor is enclosed in a glass housing by means of a technology which has long been known and proved to be suitable, so that production is simple and reliable, which leads consequently to cost reduction in comparison with the known lamp. The gas pressure ensures that dissociation and/or evaporation of components from which the capacitor is built up is counteracted. Gas composition is so chosen that no reactions with capacitor components takes place under the prevailing conditions during lamp operation. Suitable gases are, for instance, rare gases, nitrogen, oxygen, and sulphur-hexafluoride. The gas filling may consist of a single gas, but combinations of gases are also possible.

Instead of using a separate capsule, it is conceivable to fill the outer bulb itself with a suitable gas. An equivalent protection against dissociation and/or evaporation of the voltage-dependent capacitor can be achieved in this way. Heating of the capacitor can also be considerably reduced as a result of convection and conduction in the gas present in the outer bulb. The said convection and conduction, however, lead to thermal losses and adversely effect lamp efficacy. As a result, this is not a suitable solution for a great number of types of high-pressure discharge lamps.

A further advantage of the invention is that the use of the gas-filled gas-tight glass capsule for mounting the capacitor renders the measure according to the invention universally applicable for high-pressure discharge lamps.

A further improvement of the lamp can be achieved in that the gas-tight glass capsule is provided with a radiation reflecting layer. Thus it is achieved in a simple but effective manner that heating of the capacitor during lamp operation is considerably reduced. The radiation reflecting layer may be applied either externally or internally. Preferably, the voltage-dependent capacitor is positioned in such a way that the longitudinal axis of the discharge vessel lies substantially in a common plane with the capacitor, which usually has the shape of a disc. Irradiation of the capacitor is thus minimized.

In a further embodiment of a lamp according to the invention, a voltage-dependent resistor is connected in series with the capacitor. The advantage of this is that on the one hand the moment at which an ignition voltage pulse is generated can be advantageously chosen by a suitable choice of the current-voltage characteristic of the resistor. On the other hand, the resistance character of the voltage-dependent resistor ensures that the level of the generated ignition voltage pulse is limited.

A further improvement is possible in providing the ignition circuit also with a fuse. By this it is achieved that even under unfavourable conditions, such as short-circuit in the capacitor, an overload of the stabilizing ballast by extremely high currents is prevented by melting of the fuse.

BRIEF DESCRIPTION OF THE DRAWINGS

The invention will be explained in greater detail with reference to a drawing of an embodiment, in which.

DESCRIPTION OF PREFERRED EMBODIMENT

Figure 1:
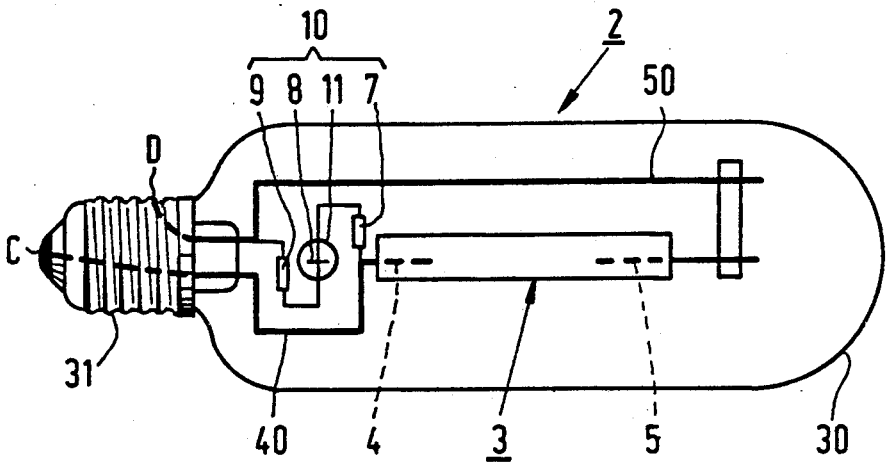
FIG. 1 is an elevation of a lamp.

In FIG. 1 is a lamp according to the invention is provided with a discharge vessel 3, which is enclosed with intervening space by an outer bulb 30, which is provided with a lamp cap 31 and with an ignition circuit 10, which comprises a voltage-dependent capacitor 8. The voltage-dependent capacitor 8 is mounted in a gas-filled gas-tight glass capsule 11. The discharge vessel 3 is provided with lamp electrodes 4 and 5, between which a discharge takes place in the operational state of the lamp. Lamp electrode 4 is connected to a lamp contact C of lamp cap 31 via a rigid current conductor 40. Similarly, lamp electrode 5 is connected to a lamp contact D of lamp cap 31 via a rigid conductor 50.

The starter circuit 10 is also provided with a fuse 7 and a voltage-dependent resistor 9.

Figure 2:
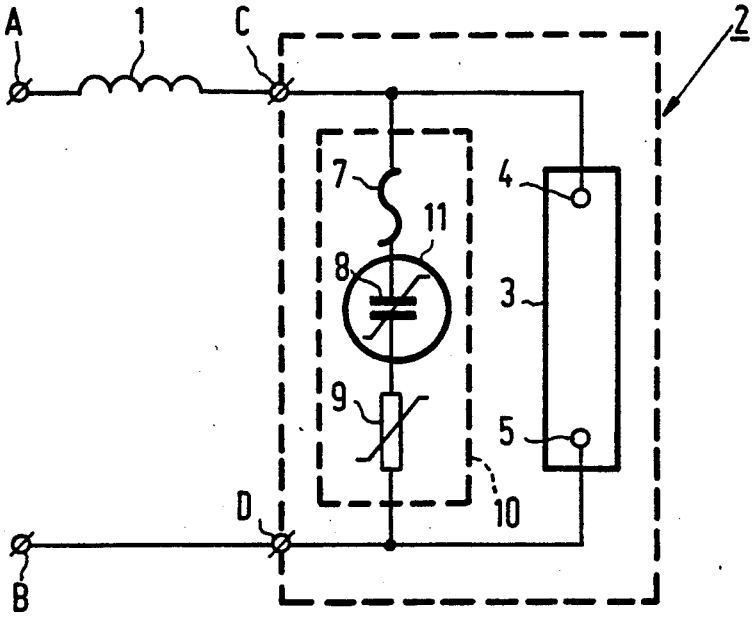
FIG. 2 is a diagrammatic representation of a circuit formed by the lamp of FIG. 1 together with a stabilizing ballast.

In FIG. 2, parts corresponding to those of FIG. 1 have corresponding reference numerals. A and B are connection terminals for connecting an AC voltage supply source. Terminal A is connected to lamp contact C via a stabilizing ballast 1. Terminal B is connected to lamp contact D. The ignition circuit 10 formed by the circuit consisting of fuse 7, voltage-dependent capacitor 8 and voltage-dependent resistor 9, together with stabilizing ballast 1 generates in a known manner ignition voltage pulses between the lamp contacts C and D and thus between the lamp electrodes 4 and 5.

The discharge vessel 3 may be provided with an external auxiliary electrode as a further ignition aid, as is well known.

In a practical embodiment of a lamp according to the invention, the lamp was a high-pressure sodium discharge lamp with a power rating of 110 W. The lamp was operated via a stabilizing ballast, type BHL125L, make Philips, at a supply voltage from a 220 V, 50 Hz source. The discharge vessel was provided with an external auxiliary electrode.

The ignition circuit was formed by a voltage-dependent capacitor 8, make TDK, which was mounted in a gas-filled gas-tight glass capsule 11. The disc-shaped capacitor was situated at approximately 20 mm from the adjacent end of the discharge vessel and lay substantially in one common plane with the longitudinal axis of the discharge vessel. The gas filling consisted of air which had a pressure of 1 atmosphere at room temperature.

Upon being connected to the 220 V 50 Hz supply source, the ignition circuit generated an ignition voltage pulse of approximately 1000 V approximately 1 ms after each zero passage of the supply voltage. A quick and reliable lamp ignition was the result.

What is claimed is:

1. A high-pressure discharge lamp comprising a discharge vessel, an outer bulb enclosing said discharge vessel with intervening space and having a lamp cap, and an ignition circuit within said outer bulb comprising a voltage-dependent capacitor, characterized in that: the capacitor is mounted in a gas-filled gas-tight glass capsule in the outer bulb.

2. A lamp as claimed in claim 1, characterized in that the glass capsule with an radiation reflecting layer.

3. A lamp as claimed in claim 2, characterized in that a voltage-dependent resistor is connected in series with the capacitor.

4. A lamp as claimed in claim 1, characterized in that a voltage-dependent resistor is connected in series with the capacitor.

* * * * *

UNITED STATES PATENT AND TRADEMARK OFFICE

CERTIFICATE OF CORRECTION

PATENT NO. : 5,053,676

DATED : October 1, 1991

INVENTOR(S) : Garardus Luijks and Hendrik Bleeker

It is certified that error appears in the above-indentified patent and that said Letters Patent is hereby corrected as shown below:

Column 4, line 18, claim 2, change "with an" to --comprises a--.

Signed and Sealed this

Twenty-first Day of June, 1994

*Attest:*

Bruce Lehman

BRUCE LEHMAN

*Attesting Officer*

*Commissioner of Patents and Trademarks*